US008196501B2

(12) United States Patent
Bilskie et al.

(10) Patent No.: US 8,196,501 B2
(45) Date of Patent: Jun. 12, 2012

(54) APPARATUS FOR SLABBING A ROLL OF MATERIAL

(75) Inventors: Eric Joseph Bilskie, Factoryville, PA (US); Wade Lynn Bleich, Middletown, OH (US); Roger William Priestner, Le Raysville, PA (US)

(73) Assignee: The Procter & Gamble Company, Cincinnati, OH (US)

( * ) Notice: Subject to any disclaimer, the term of this patent is extended or adjusted under 35 U.S.C. 154(b) by 1088 days.

(21) Appl. No.: 10/811,160

(22) Filed: Mar. 26, 2004

(65) Prior Publication Data

US 2005/0211040 A1 Sep. 29, 2005

(51) Int. Cl.
*B26D 7/01* (2006.01)

(52) U.S. Cl. ..... 83/649; 83/924

(58) Field of Classification Search ..... 83/924, 83/649, 733; 162/91

See application file for complete search history.

(56) References Cited

U.S. PATENT DOCUMENTS

| | | | | |
|---|---|---|---|---|
| 1,555,391 | A | 9/1925 | Surfus | |
| 1,838,011 | A | 12/1931 | St. Peter | |
| 3,245,302 | A | 4/1966 | Bayley | |
| 3,605,542 | A | 9/1971 | Smith et al. | |
| 4,078,282 | A | 3/1978 | van Daalen | |
| 4,461,060 | A | 7/1984 | Mannhart | |
| 4,506,575 | A | 3/1985 | McCay et al. | |
| 4,512,224 | A * | 4/1985 | Terauchi | 82/48 |
| 4,620,346 | A | 11/1986 | Loggins et al. | |
| 4,779,498 | A | 10/1988 | Perkins | |
| 4,821,971 | A * | 4/1989 | Watanabe et al. | 242/562 |
| 4,845,815 | A | 7/1989 | Nelson et al. | |
| 4,863,335 | A * | 9/1989 | Herigstad et al. | 414/495 |
| 4,864,906 | A | 9/1989 | Hall | |
| 5,199,841 | A * | 4/1993 | Von Gehlen | 414/412 |
| 5,308,217 | A * | 5/1994 | Pienta | 414/610 |
| 5,367,930 | A | 11/1994 | Lemley | |
| 5,475,917 | A | 12/1995 | Biagiotti | |
| 5,759,350 | A | 6/1998 | Pyron et al. | |
| 6,176,670 | B1 * | 1/2001 | Salsburg | 414/391 |
| 6,405,623 | B2 | 6/2002 | Lavallee | |
| 6,761,098 | B1 * | 7/2004 | Esping et al. | 83/102 |

FOREIGN PATENT DOCUMENTS

| | | |
|---|---|---|
| EP | 1 231 320 A2 | 8/2002 |
| WO | WO 00/62981 | 10/2000 |

* cited by examiner

*Primary Examiner* — Kenneth E. Peterson
(74) *Attorney, Agent, or Firm* — Peter D. Meyer

(57) ABSTRACT

An apparatus removes wound material from a roll in bulk. The apparatus comprises a transport element capable of engaging a roll of material and of transporting the roll to a slabbing position. The apparatus further comprises a cutter capable of separating the material of the roll in the slabbing position, an axial-traversing element capable of transporting the cutter along a line substantially parallel to the axis of the roll in the slabbing position, a radial-traversing element capable of transporting the cutter along a line substantially parallel to the radius of a roll in the slabbing position, and a controller capable of determining a maximum depth of cut for the cutter. The motion of the radial-traversing element is limited by the maximum depth of cut.

20 Claims, 3 Drawing Sheets

APPARATUS FOR SLABBING A ROLL OF MATERIAL

FIELD OF THE INVENTION

The present invention relates to apparatus for the bulk removal, or slabbing, of material from a wound roll of the material. The invention relates to the automated removal of residual material from a core of a wound roll of the material. The invention relates to the slabbing of rolls of web material and particularly to the slabbing of rolls of paper web material.

BACKGROUND OF THE INVENTION

Convoulutely wound rolls of material are common in the manufacturing of many products. Web materials may be manufactured and wound into rolls prior to being processed into a finished product. Wires, ropes, threads and similar materials may also be wound into rolls prior to subsequent processing. The above described rolls are commonly wound onto reusable cores. The material is unwound for processing and the reusable core is subsequently used in the winding of a new roll of material.

In some instances the unwinding and processing of the roll may be halted prior to the complete unwinding of the material from the roll. In other instances the material of the roll may be defective such that processing the material will yield an unsatisfactory product. In each of these instances, a roll remnant comprising the roll core and a residual amount of the material wound on the core will remain. The roll core may be reusable and the material may be recyclable or otherwise of value. It may be desirable to separate the residual material from the roll core.

The residual material may be cut from the roll core by hand. This process may be time consuming and may also present a risk to personnel performing the cutting of the material. The present invention provides an apparatus that may remove the residual material from the roll core. This removal may free the roll core for a subsequent use and may also provide the residual material for recycling or other uses.

SUMMARY OF THE INVENTION

The present invention provides an apparatus to remove material from the core of a wound roll of material, also known as slabbing the roll of material. The roll may have a generally cylindrical shape with a central axis, a radius, a core having a core diameter and a wall thickness and a material wound about the core. The core and the wound material may have distinct axial dimensions as well as distinct radii. The dimensions of the wound material are considered to be those dimensions of the material taken as a whole not the dimensions of a discrete portion of the material separated or otherwise distinguished from the entirety of the material wound on the roll.

The apparatus may comprise a transport element capable of engaging the roll via at least one roll-engaging element and thereafter supporting and conveying the roll to a slabbing position. The apparatus also may comprise a cutter capable of separating the material of the roll such that the material may fall from the roll. The apparatus also may comprise an axial-traversing element capable of transporting the cutter substantially parallel to, and along, the axial dimension of the material of the roll when the roll is supported in the slabbing position. The apparatus also may comprise a radial-traversing element capable of transporting the cutter substantially parallel to, and along, the radius of the roll from at least the outer diameter of the roll to the outer diameter of the core when the roll is supported in the slabbing position. The apparatus also may comprise a controller capable of determining a maximum depth of cut for the cutter. The motion of the cutter via the radial-traversing element may be limited according to the maximum depth of cut determined by the controller.

BRIEF DESCRIPTION OF THE DRAWINGS

While the claims of the invention particularly point out and distinctly claim the subject matter of the present invention, it is believed the invention will be better understood in view of the following description of the invention taken in conjunction with the accompanying drawings in which corresponding features of the several views are identically designated and in which:

DETAILED DESCRIPTION OF THE INVENTION

Definitions:

A roll as used herein is any convolutely wound, generally cylindrical, finite amount of material. The material may be wound on a core, or the material may be wound upon itself without a core. The roll may have an axial dimension for the material and a distinctly different axial dimension for any roll core. The wound material of the roll may have a radius that is distinct from the radius of the roll core. The roll may comprise any convolutedly wound material. Exemplary wound materials include, without being limiting, web materials such as metal foils, polymeric films, woven, knitted and non-woven fabrics, cellulosic webs, such as tissue paper and paper toweling, wires, yams, threads, and ropes.

A core as used herein is considered to be a generally cylindrical element upon which material may be convolutedly wound. The core may be a solid cylinder, a hollow cylinder or a partially hollow cylinder, for example, having hollow cavities at each end of the cylinder. Hollow and partially hollow cores have a core wall thickness. The core wall thickness is the radial thickness of the material comprising the outer diameter of the hollow portion of the core. The core may be comprised of glass, wood, metal, fiberglass, cardboard, carbon fiber, polymeric materials, combinations thereof, and other materials as are known in the art.

Figure 1:
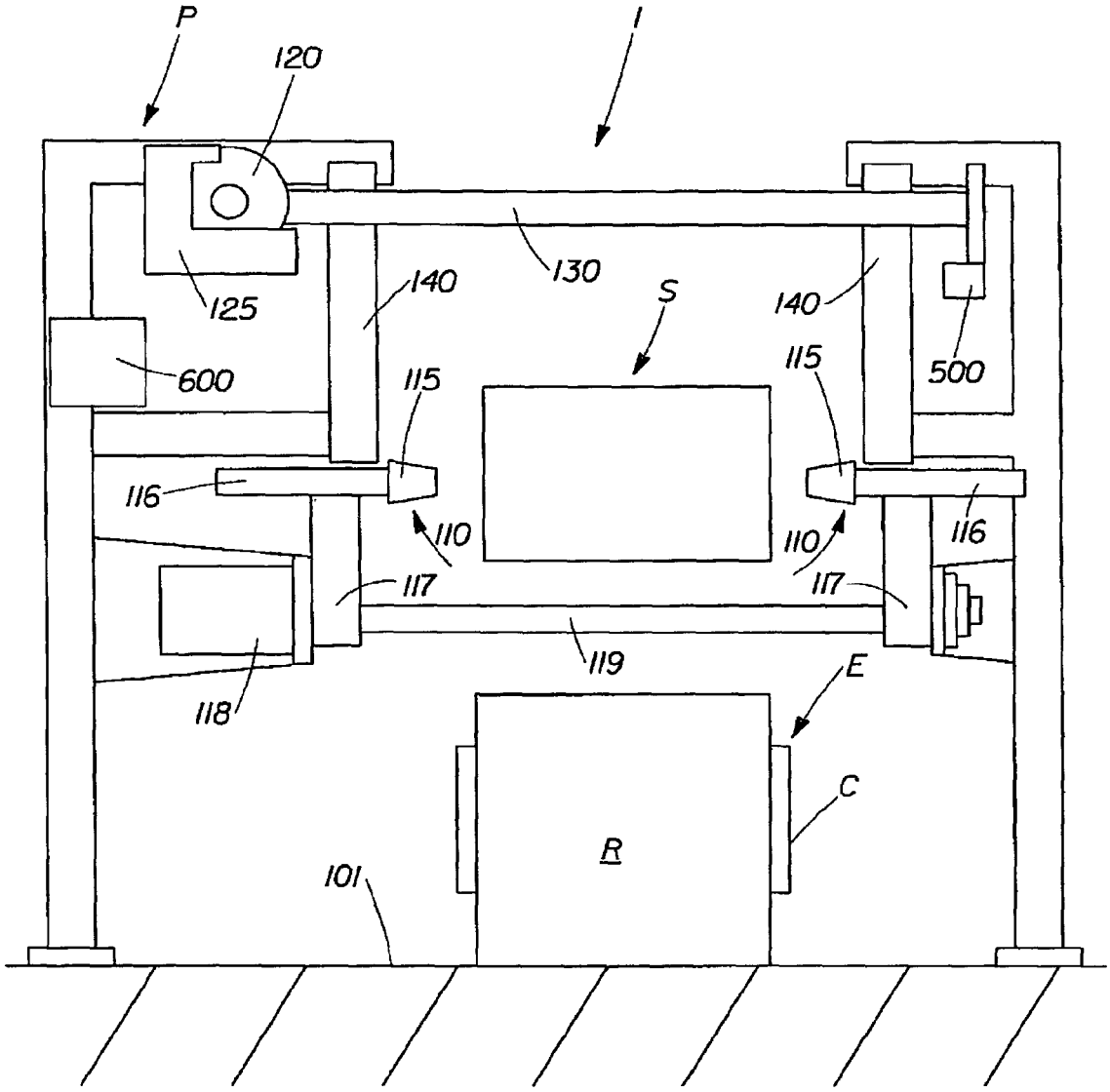
FIG. 1 is a schematic front view of one embodiment of the present invention.

The Apparatus:

According to FIG. 1, a roll R may be staged at a roll-engaging position E on a roll support surface 101. The apparatus 1 comprises a transport element 110. The transport element 110 is capable of engaging the roll R after the roll R is placed at the roll-engaging position E. In the illustrated embodiment, the transport element 110 comprises a pair of roll-engaging elements 115, and a pair of conveying elements 117. The roll-engaging elements 115 penetratingly engage the core C of the roll R as, or after the roll R is placed in the roll-engaging position E. As, or after, the roll-engaging elements 115 engage the core C of the roll R, the roll R may be transported from a roll-engaging position E to a slabbing position S via the motion the conveying elements 117. As shown, the conveying element 117 may be coupled to a shaft 119 and may be transitioned between the roll-engaging position E and the slabbing position S by the rotation of the shaft 119 directly driven by a drive unit 118. An exemplary drive unit 118 is an SEW Eurodrive Type S gearmotor, model #S97R57DT100L4, available from SEW Eurodrive, Troy, Ohio.

As or after the roll R is positioned at the slabbing position S, a cutter 120 is brought into contact with the material of the roll R and separates the material from itself. In other words, the cutter 120 cleaves the material that is wound on the roll R. The separated material may fall from the roll R. The cutter 120 is brought into contact with the material via the combined motion of an axial-traversing element 130, and a radial-traversing element 140.

As shown, the apparatus 1 may also comprise a cutter shield 125 capable of covering at least a portion of the cutter 120 when the cutter 120 is located at a cutter parking position P.

According to the figure, the apparatus 1 also comprises a controller 600 to determine a maximum depth of cut for the cutter 120. The radial motion of the cutter 120 is limited according to the determined maximum depth of cut. The controller may comprise any industrial process controller as is known in the art. A Programmable Logic Controller (PLC) is an exemplary process controller. An exemplary PLC is a CONTROL LOGIX model 5555 with a SERCOS communication interface, available from Allen Bradley, Milwaukee, Wis.

As shown, a sensor 500 may be used to detect the presence of the material of the roll R to activate a powered cutter 120, or to provide an input to the controller 500 for the determination of the radial dimensions of the material of the roll R.

The roll-engaging position E may be defined by roll supports (not shown) that comprise a portion of the roll support surface 101. Alternatively, the roll-engaging position E may be defined as a particular area of the roll support surface 101. The roll R may be moved to the roll-engaging position E by any means known in the art. Exemplary means include without being limiting, a fork lift, a roll conveyor, a roll transfer cart, and combinations thereof.

The transport element 110 may comprise one or more roll-engaging elements 115. The roll-engaging element 115 may be configured to engage the particular type of roll R being slabbed. For rolls R having solid cores, each of the roll-engaging elements 115 may comprise a hook or a hollow chuck configured according to the dimensions of the core shaft, and adapted to engage the shaft of the core C. For hollow cores, and cores having hollow cavities in the core ends, each roll-engaging element 115 may comprise shaft elements that are capable of transitioning into the hollow cavities of the core C to engage the core C. Hollow cores, and cores having hollow end cavities, may alternatively be adapted for handling by the apparatus 1 by the insertion of core inserts (not shown) into the hollow core. These core inserts may provide a uniform engagement interface surface between the apparatus 1 and the core C of the roll R. The engagement interface surface may comprise a hollow cavity or a stub shaft protruding from the side of the roll R.

In one embodiment (not shown), the core insert also comprises an ejector to facilitate the withdrawal of the roll-engaging element without an accompanying withdrawal of the core insert form the hollow core. The ejector may comprise a spring or spring-loaded element that is compressed as the core insert is engaged by the roll-engaging element and then applies a force against the roll-engaging element as the element is withdrawn to maintain the position of the core insert in the core.

The roll-engaging element 115 may engage the hollow core C, partially hollow core C, or core insert in any manner known in the art. Exemplary engagement means include without being limiting, a tapered shaft matched to a tapered bore, a splined shaft and matching bore, a matched set of complete or partial threads, and/or combinations thereof.

The roll-engaging element 115 may be transitioned between an engaged position and a disengaged position by the use of a motion end effector 116 coupled to the roll-engaging element 115. The motion end effector 116 may be any means known in the art for providing the desired motion. Exemplary motion end effectors 116 include, without being limiting, pneumatic and hydraulic cylinders, rack and pinion gear drive systems, linear and rotary actuators, and/or combinations thereof. FIG. 1 illustrates the use of pneumatic cylinders as motion end effectors 116 for the roll-engaging elements 115. An exemplary motion end effector 116 is a Parker Air Cylinder part #2CJ2MAUS19ACx 12, with a 2 in. (5 cm) bore and a 12 in. (30.5 cm) stroke, with two PSR1 limit switches, available from Parker Hannifin, Cleveland, Ohio.

In an alternative embodiment (not shown), the roll-engaging element may engage at least a portion of the outer surface of the material of the roll and support the roll by contact with this surface. This embodiment may be used for rolls having cores and also for rolls without cores.

The transport element 110 may also comprise a conveying element 117 capable of transitioning the roll-engaging element 115 at least between the roll-engaging position E and the slabbing position S. The conveying element 117 may comprise any means known in the art for transitioning a component from a first position to a second position. The conveying element 117 may comprise a pair of pivoting arms capable of supporting the roll-engaging elements 115 and capable of transitioning the engaged roll R between at least the roll-engaging position E and the slabbing position S. The conveying element may be transitioned between positions by a motion end effector 118 as is known in the art. Exemplary motion end effectors 118 for transitioning the arms include, without being limiting, pneumatic or hydraulic cylinders, any of single ended cylinders, double ended cylinders, or rodless cylinders, roller chain configurations, multi-axis robotic arms, cams and cam followers, a single rotating shaft, or a plurality of shafts. The single or plurality of shafts may be driven by direct gearing, by belts or chains, by direct coupling to a drive motor, or by a gearbox which is in turn driven by any means known in the art including, without being limiting, those means set forth above.

The motion of the conveying element 117 may present the rolls such that the core C of each roll R is conveyed to a particular and substantially identical location, regardless of the radius of the material remaining on the roll R. In this embodiment, the slabbing position S of the roll-engaging elements 115, and thus of the core C, will be substantially identical for each roll R. Alternatively, the conveying element 117 may transport each roll R until a similarly situated portion of the outer surface of each roll R reaches a predetermined and substantially identical location. In this embodiment, the position of the core C of each roll R may vary but the position of at least one similarly situated portion of the outer surface of each roll R may be substantially identical. As an example, the rolls R may be transported until the uppermost portion of the outer circumference of the roll R reaches a substantially identical position.

The cutter 120 may contact the material along a line generally parallel to the axis of the roll R in the slabbing position S. The material is separated from itself. The separated material may fall from the roll R. The cutter 120 may be a plow that is pushed through and separates the material. The cutter 120 may also be a water knife, a laser, a smooth or serrated knife blade, a powered saw blade, or a combination thereof. A powered saw may comprise a reciprocating or rotating saw blade. A powered rotating circular saw may utilize a smooth saw blade or a toothed blade to separate the material of the roll R. Other means appropriate for separating the particular material of the roll R as are known in the art, may be used as the cutter 120. An exemplary cutter 120 comprises a 16 in. (40.6 cm) circular blade on the output shaft of a Bayside 5:1 ratio gearbox, part # PS115-005 available from Bayside Motion Group, Port Washington, N.Y., driven by an Allen Bradley servo motor part # MPL-A430H-HK22AA, available from Allen Bradley, Milwaukee, Wis.

The apparatus 1 may also comprise an axial-traversing element 130 capable of conveying the cutter 120 along a line substantially parallel to the axis of roll R when the roll R is in the slabbing position S. The axial-traversing element 130 may convey the cutter 120 over at least the axial length of the material of the roll R. The motion of the axial-traversing element 130 may be controlled by the controller 600 and may be limited by physical stops (not shown), by the controller programming according to inputs from axial-traversing-element position sensors (not shown), according to predetermined transit time intervals, according to provided limits relating to the width of the material of the roll R, and/or combinations thereof. The axial-traversing element 130 may comprise any means known in the art capable of conveying the cutter 120 along a line generally parallel to the axis of the roll R in the slabbing position S. Exemplary means include, without being limiting, linear actuators, a combination of motion end effector and at least one guide rail, belt systems, chain systems, single, double, and rod-less cylinders. The cylinder may be pneumatic or hydraulic. The axial-traversing element 130 may comprise other motion generating means as are known in the art, and combinations thereof. An exemplary axial-traversing element 130 is a Bosch/Rexroth, STAR LINEAR MODULE, ball screw actuator model #MKR 25-110× 5000 mm, available from Bosch/Rexroth, Hoffman Estates, Ill., driven by an Allen Bradley MPL-A430H-HK22AA servo motor with a brake available from Allen Bradley, Milwaukee, Wis.

The axial-traversing element 130 may be configured to convey the cutter 120 beyond the axial dimension of the material of the roll R. In the embodiment illustrated in FIG. 1, the cutter 120 may be conveyed by the axial-traversing element 130 to a cutter-parking position P. Conveying the cutter 120 to the cutter-parking position P may remove the cutter 120 from the path of a roll R being conveyed to the slabbing position S.

The axial-traversing element 130 may have a predetermined home position in the apparatus. The home position may be a location to which the load carried by the axial-traversing element is returned when the slabbing process is completed and at which the load remains until the process is initialized. The home position may correspond with the cutter-parking position P.

The apparatus 1 may also comprise a radial-traversing element 140 capable of conveying the cutter 120 along a line parallel to the radius of the roll R when the roll R is in the slabbing position S. The radial-traversing element may convey the cutter over at least the distance from the outer surface of the roll R to the outer surface of the core C. The motion of the radial-traversing element 140 may be controlled by the controller 600 and may be limited by radius of the material of the roll R, or a maximum depth of cut, as determined by the controller 600, by predetermined time intervals, by physical stops (not shown), and/or combinations thereof. The radial-traversing element 140 may comprise any means known in the art capable of conveying the cutter 120 along a line generally parallel to the radius of the roll R in the slabbing position S. Exemplary means include, without being limiting, linear actuators, a combination of a motion end effector and at least one guide rail, belt systems, chain systems, single, double, and rod-less cylinders. The cylinder(s) may be pneumatic or hydraulic. The radial-traversing element 140 may comprise other motion generating means as are known in the art, and combinations thereof. An exemplary radial-traversing element 140 is a Bosch/Rexroth, STAR LINEAR MODULE, ball screw actuator model #MKR 25-110×1150 mm, available from Bosch/Rexroth, Hoffman Estates, Ill., driven by an Allen Bradley MPL-A430H-HK24AA servo motor with a brake available from Allen Bradley, Milwaukee, Wis.

The radial-traversing element 140 may have a predetermined home position in the apparatus. The home position may be a location to which the load carried by the radial-traversing element is returned when the slabbing process is completed and at which the load remains until the process is initialized.

The radial-traversing element 140 and the axial-traversing element 130 may cooperate to bring the cutter 120 into contact with the material of the roll R to separate the material from the roll R without contacting the core C with the cutter 120. The cutter 120 may be attached to either the axial-traversing element 130 or the radial-traversing element 140.

In the embodiment illustrated in FIG. 1, the cutter 120 is attached to the axial-traversing element 130. The axial-traversing element comprises a rodless cylinder. The axial-traversing element 130 is in turn, attached to a pair of rodless cylinders that comprise the radial-traversing element 140.

In another embodiment (not shown), the functions of the axial-traversing element 130 and radial-traversing element 140 may be combined in a single element. This embodiment is still considered to have an axial and radial traversing element because the cutter may still be conveyed in both the axial and radial directions. As an example, a multi-axis robotic arm may be used to convey the cutter along the axis and radius of a roll in the slabbing position S. In this embodiment, the robotic arm is considered to be both the axial and radial traversing element since the arm performs the functions of both of these elements.

The cutter 120 may have a finite depth of cut as it traverses the roll R and separates the material. The depth of cut may be less than the radius of the material of a roll R to be slabbed. The controller 600 may be configured to control the motion of the radial-traversing element 140 and the axial-traversing element 130 such that the cutter 120 makes a plurality of traverses along the roll R until substantially all of the material is separated from the core C. The controller 600 may limit the radial position of the cutter 120 such that a residual portion of the material remains on the core C to avoid any contact between the cutter 120 and the core C of the roll R. When a plurality of traverses are made, the cutter 120 may separate material as it proceeds in one direction or both directions along a line substantially parallel to the axis of the roll R.

In the embodiment illustrated in FIG. 1, a core wall thickness is provided to the controller 600 by an operator via a human machine interface (not shown). The controller 600 determines a maximum depth of cut (MDC) for the cutter according to the known position of the roll-engaging elements 115 in the slabbing position S and the provided core wall thickness. The MDC may also include an error margin to prevent contact between the cutter 120 and the core C. The controller 600 also determines a series of cutting depths beginning with the MDC and proceeding up from that point.

An exemplary series of cutting depths may be: MDC, MDC+7.5 cm, MDC+15 cm, MDC+22.5 cm, MDC+30 cm, MDC+37.5 cm, MDC+45 cm.

The engaging elements 115 may engage the core C of the roll R and the engaged roll R may be conveyed to the slabbing position S that fixes the position of the outer surface of the core C according to known position of the roll-engaging elements 115 and the provided core wall thickness. The pair of rodless cylinders comprising the radial-traversing element 140 lowers the axial-traversing element 130/cutter 120 combination to the uppermost cutting depth of the determined series.

According to FIG. 1, a sensor 500, capable of detecting the material of the roll R, may be lowered in combination with the cutter 120 and the axial-traversing element 130. If sensor 500 does not detect material at the uppermost cutting depth, the radial-traversing element 140 continues to lower the axial-traversing element 130/cutter 120 combination to the next cutting depth. This iterative process is continued until the sensor 500 detects material. After the sensor 500 detects material, the cutter 120 is energized to rotate the saw blade and the cutter 120 is traversed along the axis of the roll R by the motion of the axial-traversing element 130.

In another embodiment (not shown), the axial-traversing element may traverse the axis of the roll with the cutter according to the determined series of cut depths and without input from a sensor. In this embodiment the cutter may make one or more traverses of the roll without contacting the material of the roll.

In the embodiment illustrated in FIG. 1, the radial-traversing element 140 will lower the axial-traversing element 130/cutter 120 combination after each traverse until the MDC is reached. After a traverse of the axis of the roll R at the MDC, the radial-traversing element 140 will raise the axial-traversing element 130/cutter 120 combination to the home position of the radial-traversing element 140 and the axial-traversing element 130 will move the cutter 120 to the cutter-parking position P.

The sensor 500 may be disposed as described above to descend with the cutter 120 and to detect the presence of material for cutting. Alternatively, the sensor 500 may be disposed in a fixed location and used to provide an input to determine the diameter of the roll R. As an example, the sensor 500 may be fixedly disposed above the roll-engaging position E and oriented to measure the distance between the sensor 500 and the detected material of a roll R placed in the roll-engaging position E. This measured distance may be provided to the controller 600. The diameter and wall thickness of the core C may also be provided to the controller 600 via a human machine interface or by other means known in the art. The controller 600 may then determine the diameter of the roll R, radius of the material of the roll R and a maximum depth of cut for the roll R together with a series of cutting positions for the cutter 120.

The roll R may then be transported to the slabbing position S and the slabbing of the material of the roll R may proceed as described above.

The sensor 500 may be a surface-contacting or non-surface-contacting sensor. Exemplary sensors include without being limiting, ultrasonic sensors, convergent-beam electromagnetic sensors, and linear position sensors as are known in the art.

The output of the sensor 500 may be communicated to the controller 600 by any means known in the art. Exemplary means include without being limiting, directly wiring the output of the sensor to the input circuits of the controller, wireless communication between the sensor and a wireless receiver connected to the controller, providing the output as at least a portion of a multiplexed input to the controller, and combinations thereof. The foregoing description applies to any and all sensors discussed herein.

In an alternative embodiment (not shown), the sensor may detect the outer surface of the roll after the roll has been engaged by the roll-transport element and moved to the slabbing position. In this embodiment, rolls may be moved to a slabbing position such that the core of each roll is placed in a predetermined and substantially identical position. The output of the sensor together with the predetermined core position, and a provided core wall thickness, may then be used by the controller to determine the radius of the wound material of the roll, the MDC and the cutting position series.

In yet another embodiment (not shown), the conveying element may convey the roll such that the upper outer surface of the roll is brought to a predetermined and substantially identical location. In this embodiment, a first sensor may provide the controller with the position of the roll-engaging elements relative to a second sensor. The controller may then use the output of the first sensor together with the output from the second sensor, and a provided core wall thickness to determine a radius of the wound material of the roll, an MDC and a cutting position series as described above.

Figure 2:
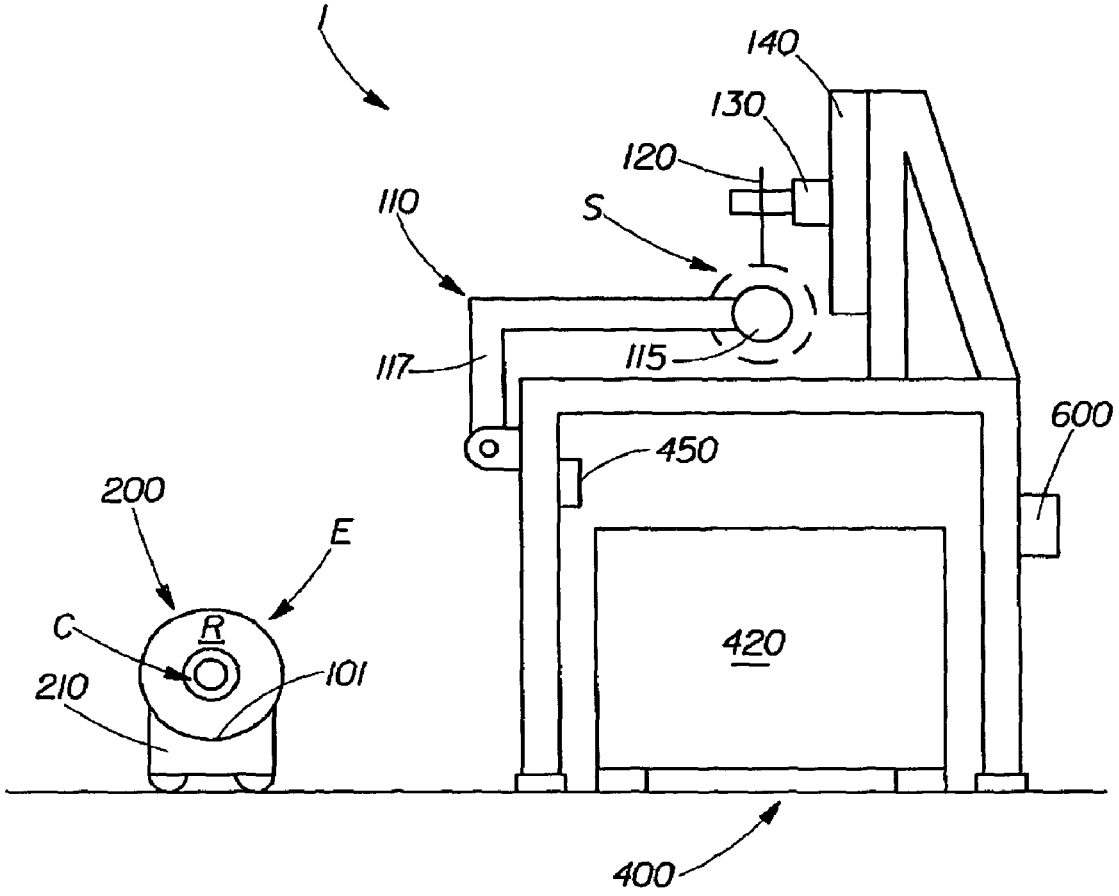
FIG. 2 is a schematic side view of another embodiment of the present invention.

In the embodiment illustrated in FIG. 2, the apparatus 1 further comprises a feed section 200 adjacent to the slabbing position S. The feed section may comprise a roll holding surface 101. In the illustrated embodiment, the feed section 200 comprises a roll-transfer cart 210 capable of supporting a roll R as the roll R is transported to the apparatus 1. The roll-transfer cart 210 may be used to position the roll R at the above described roll-engaging position E.

In another embodiment (not shown), the path taken by the conveying element may require the use of a plurality of roll-engaging positions. The path of the conveying element may not permit the engaging of a complete range of roll diameters. The path of the conveying element may sweep through a circular arc. The core of a roll must be disposed along this arc to be engaged by the roll-engaging elements supported by the conveying element. Therefore in this embodiment, it may be advantageous to identify and designate a plurality of roll-engaging positions according to distinct ranges of roll diameters.

In an alternative embodiment (not shown), the feed section may comprise a roll conveyor capable of receiving a roll and of subsequently conveying the roll R to the roll-engaging position.

Figure 3:
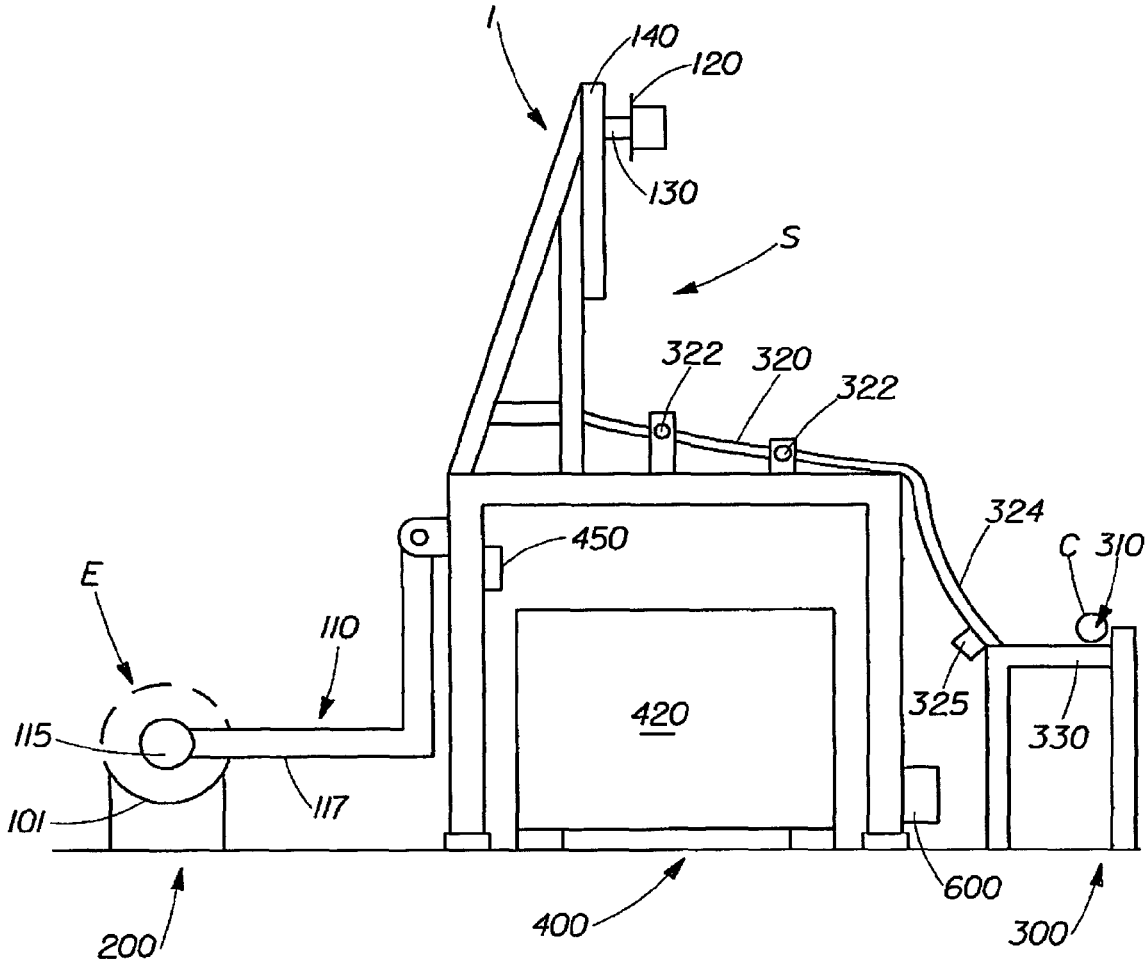
FIG. 3 is a schematic side view of yet another embodiment of the present invention.

In another embodiment illustrated in FIG. 3, the apparatus 1 further comprises a discharge section 300. The discharge section 300 may comprise a core-removal position 310. In this embodiment, side-roll-down rails 320 may be transitioned from a retracted position at the sides of the apparatus to an extended position beneath the core C. After the roll R is slabbed, the side-roll-down rails 320 are extended to the position beneath the core C. The roll-engaging elements 115 retract from the core C and the core C is transferred to the side-roll-down rails 320. The core C may proceed along the side-roll-down rails 320 to the core-removal position 310 on a discharge table 330. Alternatively, the roll R may be transported from the slabbing position S to the core-removal position by the conveying element 117, by gravity, or by other means known in the art. After the core C is received at the discharge section the side-roll-down rails 320 are retracted to clear the path of subsequent rolls R to be slabbed.

The side-roll-down rails 320 may be actuated by any means known in the art. Exemplary means include without being limiting, hydraulic and pneumatic cylinders, linear servo motors, linear actuators, rotary actuators, and combinations thereof. In the illustrated embodiment, the side-roll-down rails are actuated between positions by air cylinders 322. An exemplary air cylinder is a Parker model # 2CBE2MAUS18ACx 7 with two PSR1 limit switches available from Parker Hannifin, Cleveland, Ohio.

Residual material may be removed at the core-removal position 310. Alternatively, the core C may be removed from the core-removal position 310 and any residual material may be subsequently removed.

The discharge section 300 may also comprise a core-conveying means 324 configured to receive a core C from the slabbing position S, the conveying element 117 or the side-roll-down rails 320 and to subsequently convey the core C to the core-removal position 310. This conveying means 324 may be any conveying means known in the art. Exemplary conveying means include without being limiting, belt conveyors, mat-top and table-top chain conveyors, drag chain conveyors, a core slide, a core cradle couple to a vertically oriented pneumatic cylinder, and/or combinations thereof. As an example a core cradle fabricated from mild steel may be actuated by a Parker model # CJ2MAUS39ACx60 air cylinder with twp PSR1 limit switches, available from Parker Hannifin, Cleveland, Ohio.

The discharge section 300 may comprise a discharge-full sensor 325 configured to detect a core C at a particular location and to provide an input to the controller 600 to indicate the presence of the core C. The controller 600 may be programmed to prevent the transfer of any additional cores to the discharge section 300 until the discharge-full sensor 325 no longer indicates the presence of a core C at the particular location.

According to the embodiments illustrated in FIGS. 2 and 3, the apparatus 1 may further comprise a material-removal section 400. The material-removal section 400 may be disposed at least partially beneath the slabbing position S. As material is separated from the roll R, gravity may facilitate the transfer of the material from the slabbing position S to the material-removal section beneath the slabbing position S. Air jets and air knives (not shown), as are known in the art, may also be used to assist in the transfer of slabbed material from the roll R to the material-removal section 400. The material-removal section 400 may comprise a hopper 420 configured to catch the material falling from the slabbing position S. In an alternative embodiment (not shown), the material-removal section may comprise a conveying means as is known in the art for receiving the falling material and subsequently transporting the material to a material hopper or a material receiving section of a material recycling process.

In these embodiments, the material-removal section 400 may also comprise a material sensor 450 configured to determine that there is sufficient space to accommodate the material of a roll R to be slabbed. For an embodiment comprising a hopper 420, the sensor 450 may indicate that the hopper 420 is filled to capacity and needs to be emptied or replaced. For an embodiment comprising a material conveyor, the sensor 450 may indicate that the material conveyor is inoperative or filled with material.

The process of conveying the roll R from the feed section through slabbing and to the core-removal position of the discharge section may be automated as is known in the art. The apparatus 1 may be configured with appropriate guarding to prevent the operation of the apparatus when it is possible that personnel may be in the path of moving apparatus elements Instrumented guards, light curtains, optical sensors, and other means known in the art may be used to provide input to the controller to indicate that the apparatus may be safely operated.

The apparatus 1 may also be configured with additional position sensors to provide an indication of the position of each element of the apparatus 1. These sensors may provide inputs to the controller 600 to be used in the programmed automation of the apparatus 1.

One of skill in the art will understand that structural members may be required to support the above described apparatus 1 and that such members may be fabricated from any material capable of withstanding the stresses of the operation of the apparatus 1. Suitable materials include, without being limiting, mild, hardened, and stainless steels, cast iron, aluminum and other metals, fiberglass and other composite materials, polymeric materials, other structural materials known in the art and combinations thereof.

One of skill in the art would understand that the operation of the apparatus 1 may be effected by the outputs of the controller 600 through appropriate hardware such as motor starters, pneumatic and/or hydraulic control valve systems depending upon the details of the motion end effectors selected as components of the apparatus. These elements will not be further discussed here.

EXAMPLE 1

A roll comprising a core and a residual portion of a paper web material is placed upon a roll transfer cart. The cart is used to transport the roll into a feed section enclosed by an instrumented gate. The roll transfer cart and roll are staged at the roll-engaging position designated according to the diameter of the roll. The gate is closed. A limit switch provides an input to a controller to indicate that the gate is closed. An operator provides the core diameter and wall thickness, together with the width of the material of the roll, to the controller and initiates the operation of the slabbing apparatus from a remote human machine interface.

The transport element moves from the slabbing position toward the roll-engaging position. The speed of the transport element is reduced when a core detection sensor detects the material of the roll. The motion of the transport element is stopped when the core detection sensor detects the core or when the physical stops are reached whichever occurs first. The roll-engaging elements of the transport element are moved into engagement with the core. The motion of the roll-engaging elements is confirmed by roll-engaging-element position sensors.

The transport element comprises a pair of arms pivoting on a directly drive shaft. The shaft is directly driven by an electric motor gearbox combination. The arms support a pair of spindles coupled to air cylinders. When the transport element is at the roll-engaging position, the extension of the air cylinders will engage the spindles with the core of a staged roll.

The transport element proceeds from the roll-engaging position to the slabbing position. The motion of the transport element is stopped when a slabbing position limit switch is engaged by the transport element or the transport element upper physical stops are reached. The slabbing position presents the roll-engaging elements at a substantially identical position for each roll.

The controller determines the position of the upper surface of the core according to the known position of the roll-engaging elements and the provided core wall thickness. The controller also determines a maximum depth of cut and a series of cutting positions based upon the depth of cut of the cutter.

The cutter is a servo driven circular saw with a smooth blade. The cutter is attached to an axial-traversing element. The axial-traversing element is a horizontally oriented rodless pneumatic cylinder. The axial-traversing element is attached to a pair of vertically oriented rodless cylinders that function as the radial-traversing element.

When the process is initialized, the radial-traversing element and axial-traversing element are each positioned in their respective home positions such that the cutter is in the cutter parking position behind a cutter shield and out of the path of the next roll to be slabbed.

The controller provides an output to the radial-traversing element to lower the cutter and axial-traversing element to an initial cutting position. The radial-traversing element continues to lower the cutter through the sequence of cutting positions until a material sensor detects material on the roll. After the cutter has reached a cutting position with material detected on the roll the radial-traversing element stops.

The axial-traversing element begins to move the cutter toward the roll and the cutter drive is energized to rotate the cutting blade. The cutter proceeds for a predetermined distance along a line substantially parallel to the axis of the roll. The distance is predetermined according to the provided width of material on the rolls being slabbed.

The cutting continues until the maximum depth of cut for the type of roll core being slabbed is reached. The maximum depth of cut for a variety of roll cores may be stored in the controller and selected as necessary, or may be determined by the controller.

After the cutting at the maximum depth of cut has occurred, the cutter is de-energized the radial and axial traversing elements return the cutter to the cutter-parking position.

As, or after, the axial and radial traversing elements reach the cutter parking position, side-roll-down rails extend from each end of the apparatus to positions beneath the freshly slabbed core. The roll-engaging elements withdraw from the core until roll-engaging-element position sensors indicate the complete withdrawal of the roll-engaging elements. The core is transferred to and proceeds along the side-roll-down rails to the discharge area. The transport element remains in the slabbing position until the process is initialized for the next roll.

When the core engages the core discharge sensor, the side-roll-down rails retract and the core is transferred to the core discharge table. Cores may accumulate on the discharge table. When cores have accumulated on the discharge to an extent that the discharge-full sensor is engaged the process will be prevented from proceeding.

The final vestiges of material may be removed from the core on the core discharge table.

EXAMPLE 2

A roll remnant is transported to a roll conveyor and placed upon the roll conveyor by a roll-handling clamp truck. The roll conveyor transports the roll from a roll-receiving location to a roll-engaging location.

A sensor detects the presence of the roll at the roll-engaging position and a transport element is moved to a position aligned with the core of the roll. The roll is engaged by the transport element. The transport element is comprised of opposing pairs of rodless cylinders. Each pair comprises a fixed horizontal cylinder supporting a vertically oriented cylinder. The vertically oriented cylinder in turn supports a roll engagement spindle coupled to an air cylinder oriented parallel to the axis of the rolls in the roll-engaging position. The transport element further comprises an optical sensor aligned with a reflector along a line parallel to the axis of a roll in the roll-engaging position. The motion of the transport element proceeds from the home position of the element toward the roll-engaging position until the path between the sensor and reflector is blocked by the material of the roll. The motion is then slowed until the path between the sensor and reflector clears as the beam of the sensor passes through the roll core and is reflected. The air cylinders extend and the spindles engage each end of the core of the roll.

Roll-engaging element sensors indicate that the roll-engaging elements have extended completely. The transport element rodless cylinders then transport the roll to the slabbing position. The roll is lifted by the motion of the vertically oriented rodless cylinders and transported horizontally by the horizontally oriented rodless cylinders. This combination of horizontal and vertical movement of the roll may occur simultaneously or sequentially. The position of the roll-engaging elements is substantially identical for each roll slabbed. The position of the load of the rodless cylinders is provided to the controller by a linear position indicating sensor. An overhead sensor determines the distance between the sensor and the material of the roll. This distance is provided as an input to the controller. The controller is also provided with the wall thickness of the core as an input via a human-machine interface. Using the known position of the roll-engaging element, the provided wall thickness, and the determined distance between the overhead sensor and the roll material, the controller determines the maximum depth of cut and the schedule of cut positions for the roll to be slabbed.

The radial-traversing element comprising a vertically oriented driven rack and pinion system at one end of the apparatus together with a vertically oriented idler rack and pinion at the opposing end of the apparatus is actuated to lower the cutter assembly toward the roll. The position of the radial-traversing element is provided by a gear detecting sensor providing an input to the controller allowing the controller to count the teeth of the pinion as the pinion rotates. The pinion is driven by an air motor.

A material detection sensor is in line with the cutting assembly and configured to detect any material along the axial path of the cutter. When the cutting assembly reaches the uppermost cut position of the determined cut position schedule, the controller checks the input from the material detection sensor.

If no material is detected, motion of the radial-traversing element continues to each successive cut position until a cut position is reached where material is detected.

If material is present, the controller stops the descent of the radial-traversing element and initiates an axial traverse of the roll by the cutter. The axial-traversing element comprises a rack and pinion system having a horizontally oriented rack aligned with the axis of a roll in the slabbing position. The position of the axial-traversing element is provided by a gear detecting sensor providing an input to the controller allowing the controller to count the teeth of the pinion as the pinion rotates. The pinion is driven by an air motor.

The cutter comprises a fixed knife blade attached to the pinion such that the knife blade does not rotate as the pinion traverses the roll. The knife blade is brought into contact with the material of the roll and separates the material. The knife blade is configured to cut in either direction as it traverses the roll. Therefore, after the initial traverse, the radial-traversing element lowers the cutting assembly to the next cut position prior to the return traverse. After the cutting assembly traverses the roll at the maximum depth of cut determined by the controller, the radial-traversing element returns to its home position and the cutting assembly is returned to its home position at one end of the axial-traversing element.

The transport element proceeds from the slabbing position to a discharge position. The roll is transported horizontally away from the feed section and then lowered to a discharge conveyor. When the position sensors of the transport element indicate that the roll is at the discharge conveyor, the roll-engaging elements withdraw from the core and the core is transferred to the discharge conveyor. The discharge conveyor carries the slabbed roll to a roll accumulating position.

When sufficient cores accumulate to block the accumulator full sensor, the controller provides a signal to the machine operator and disables the automatic functioning of the slabber apparatus.

All documents cited in the Detailed Description of the Invention are, in relevant part, incorporated herein by reference; the citation of any document is not to be construed as an admission that it is prior art with respect to the present invention.

While particular embodiments of the present invention are illustrated and described, it would be obvious to those skilled in the art that various other changes and modifications can be made without departing from the spirit and scope of the invention. It is therefore intended to cover in the appended claims all such changes and modifications that are within the scope of the invention.

What is claimed is:

1. An apparatus for slabbing a roll having a generally cylindrical shape, an axis, an axial dimension, a radius, a core having a core diameter an outer circumference and a wall thickness, and a material having an outer circumference wound around the core, the apparatus comprising:

a) a transport element capable of engaging the roll and of conveying the roll to a slabbing position, said transport element further comprising a pair of roll engaging elements capable of penetrating engagement of the core, b) a cutter capable of separating the material of the roll, c) an axial-traversing element capable of transporting the cutter at least along the entire axial dimension of the material of the roll as, or after, the roll is transported to the slabbing position, d) a radial-traversing element capable of transporting the cutter at least from the outer circumference of the roll to the outer circumference of the core as, or after, the roll is transported to the slabbing position, and e) an interface for inputting a core wall thickness, f) a controller capable of determining a maximum depth of cut according to a known position of the roll engaging elements in the slabbing position and the inputted wall thickness of the core, wherein the motion of the radial-traversing element is limited according to the determined maximum depth of cut.

2. The apparatus according to claim 1 wherein the cutter comprises a powered cutting blade.

3. The apparatus according to claim 1 further comprising a feed section disposed adjacent to the slabbing position, wherein the transport element is capable of engaging a roll disposed in the feed section and of conveying the roll from the feed section to the slabbing position.

4. The apparatus according to claim 1 further comprising a discharge section disposed adjacent to the slabbing position, wherein the roll may be conveyed to the discharge section from the slabbing position.

5. The apparatus according to claim 1 further comprising a material removal section disposed at least partly beneath the slabbing position and capable of receiving material separated from the roll.

6. The apparatus according to claim 1 wherein the cutter is attached to the axial-traversing element and the axial-traversing element is attached to the radial-traversing element.

7. The apparatus according to claim 6 wherein the axial-traversing element is capable of transporting the cutter beyond the entire axial dimension of the roll to a cutter parking position.

8. The apparatus according to claim 1 further comprising a sensor capable of detecting the material of the roll.

9. An apparatus for slabbing a roll having a generally cylindrical shape, an axis, an axial dimension, a radius, a core having a core diameter an outer circumference and a wall thickness, and a material having an outer circumference wound around the core, the apparatus comprising:

a) a transport element capable of engaging the roll and of conveying the roll to a slabbing position, said transport element further comprising two roll engaging elements capable of engaging said core, b) a cutter capable of separating the material of the roll, c) an axial-traversing element capable of transporting the cutter at least along the entire axial dimension of the material of the roll as, or after, the roll is transported to the slabbing position, d) a radial-traversing element capable of transporting the cutter at least from the outer circumference of the roll to the outer circumference of the core as, or after, the roll is transported to the slabbing position, e) an interface for inputting a core wall thickness, f) a controller capable of determining a maximum depth of cut according to the inputted core wall thickness and a known position of the roll engaging elements in the slabbing position, and g) a material removal section disposed at least partly beneath the slabbing position and capable of receiving material separated from the roll, wherein the motion of the radial-traversing element is limited according to the determined maximum depth of cut.

10. The apparatus according to claim 9 wherein the cutter comprises a powered cutting blade.

11. The apparatus according to claim 9 further comprising a feed section disposed adjacent to the slabbing position, wherein the transport element is capable of engaging a roll disposed in the feed section and of conveying the roll from the feed section to the slabbing position.

12. The apparatus according to claim 9 further comprising a discharge section disposed adjacent to the slabbing position, wherein the roll may be conveyed to the discharge section from the slabbing section.

13. The apparatus according to claim 9 wherein the cutter is attached to the axial-traversing element and the axial-traversing element is attached to the radial-traversing element.

14. The apparatus according to claim 13 wherein the axial-traversing element is capable of transporting the cutter beyond the entire axial dimension of the roll to a cutter parking position.

15. The apparatus according to claim 9 further comprising a sensor capable of detecting the material of the roll.

16. An apparatus for slabbing a roll having a generally cylindrical shape, an axis, an axial dimension, a radius, a core having a core diameter an outer circumference and a wall thickness, and a material having an outer circumference wound around the core, the apparatus comprising:

a) a transport element integral with said apparatus that engages the roll and conveys the roll to a slabbing position, said transport element further comprising two roll engaging elements capable of engaging said core, b) a cutter that separates the material of the roll from itself, c) an axial-traversing element that transports the cutter at least along the entire axial dimension of the material of the roll as, or after, the roll is transported to the slabbing position, d) a radial-traversing element that transports the cutter at least from the outer circumference of the roll to the outer circumference of the core as, or after, the roll is transported to the slabbing position, e) an interface for inputting a core wall thickness, f) a controller that determines a maximum depth of cut according to a known position of the roll engaging elements in the slabbing position and the inputted wall thickness of the core, g) a material removal section disposed at least partly beneath the slabbing position that receives material separated from the roll, h) a feed section comprising a roll-engaging position and disposed adjacent to the slabbing position, and i) a discharge section comprising a core-removal position and disposed adjacent to the slabbing position, wherein the motion of the radial-traversing element is limited according to the determined maximum depth of cut.

17. The apparatus according to claim 16 wherein the cutter comprises a powered cutting blade.

18. The apparatus according to claim 16 wherein the cutter is attached to the axial-traversing element and the axial-traversing element is attached to the radial-traversing element.

19. The apparatus according to claim 16 wherein the axial-traversing element is capable of transporting the cutter beyond the entire axial dimension of the roll to a cutter parking position.

20. The apparatus according to claim 16 further comprising a sensor capable of detecting the material of the roll.

* * * * *